US006752392B2

(12) United States Patent
Fricke et al.

(10) Patent No.: US 6,752,392 B2
(45) Date of Patent: Jun. 22, 2004

(54) DEVICE FOR PICKING UP A SHEET TRAILING EDGE FROM AN UPSTREAM CYLINDER AND FOR TRANSFERRING THE SHEET TRAILING EDGE TO A GRIPPER SYSTEM

(75) Inventors: Andreas Fricke, Eberbach (DE); Michael Puckl, Mildenau ot Arnsfeld (DE); Ludwig Reinhard, Heidelberg (DE); Matthias Schuster, Heidelberg (DE); Gunter Siebdrath, Chemnitz (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 65 days.

(21) Appl. No.: 10/254,728

(22) Filed: Sep. 25, 2002

(65) Prior Publication Data

US 2003/0057643 A1 Mar. 27, 2003

(30) Foreign Application Priority Data

Sep. 25, 2001 (DE) ..... 101 48 423

(51) Int. Cl.[7] ..... B65H 29/00
(52) U.S. Cl. ..... 271/186; 221/310
(58) Field of Search ..... 221/306, 307, 221/310, 183, 194, 196, 186, 291; 399/364; B65H 29/54, 29/68, 29/00

(56) References Cited

U.S. PATENT DOCUMENTS

| | | | | |
|---|---|---|---|---|
| 5,163,671 A | * | 11/1992 | Walters | 271/186 |
| 6,254,089 B1 | | 7/2001 | Becker et al. | |
| 6,513,805 B2 | * | 2/2003 | Takida et al. | 271/291 |

FOREIGN PATENT DOCUMENTS

| | | | | |
|---|---|---|---|---|
| DE | 870 704 | | 7/1952 | |
| DE | 43 32 491 C2 | | 3/1995 | |
| DE | 196 11 587 A1 | | 10/1996 | |
| DE | 198 04 039 A1 | | 8/1999 | |
| DE | 198 33 903 A1 | | 2/2000 | |
| JP | 5-107977 | * | 4/1993 | G03G/25/20 |

* cited by examiner

*Primary Examiner*—Donald P. Walsh
*Assistant Examiner*—Kenneth W Bower
(74) *Attorney, Agent, or Firm*—Laurence A. Greenberg; Werner H. Stemer; Gregory L. Mayback

(57) ABSTRACT

A device for picking up a sheet trailing edge from an upstream cylinder and transferring the sheet trailing edge to a gripper system of a downstream drum, as viewed in sheet travel direction, includes a sucker guide mechanism having a movably mounted sucker carrier whereon sucker heads subjectible to an application of vacuum or suction air are disposed. The sucker carrier is constructed as a tubular part having a longitudinal axis and being movable perpendicularly to the longitudinal axis thereof. The tubular part is formed with a vacuum or suction air duct extending in the interior thereof and is formed of carbon fiber-reinforced plastic-material laminate.

22 Claims, 3 Drawing Sheets

DEVICE FOR PICKING UP A SHEET TRAILING EDGE FROM AN UPSTREAM CYLINDER AND FOR TRANSFERRING THE SHEET TRAILING EDGE TO A GRIPPER SYSTEM

BACKGROUND OF THE INVENTION

Field of the Invention

The invention relates to a device for picking up a sheet trailing edge from an upstream cylinder, as viewed in sheet travel direction, and for transferring the sheet to a gripper system, especially in a sheet-fed rotary printing press.

A device of this general type has been disclosed heretofore in German Published, Non-Prosecuted Patent Application DE 198 33 903 A1, corresponding to U.S. Pat. No. 6,401,610. The functional principle of such so-called single-drum turning or reversing, requires storage on the upstream impression cylinder of the sheet to be turned or reversed. Gripping and removal of the trailing edge therefore has to be performed by suckers, which transfer the trailing edge to grippers of the turning drum before the leading edge is released by the grippers of the impression cylinder. In order to have the largest possible machine angle intervals available for these transfer operations and to peel off the trailing sheet region from the impression cylinder with as continuous a tangent as possible and to be able to transfer the trailing sheet region to further gripper elements of the turning drum, the application of suction to the trailing edge must begin as early as possible. The suckers, which are located on a sucker carrier, have to move along a curved path which contains three sections required by the process. In addition, in all three sections, specific positional angles of the suction surfaces to the impression cylinder are required, for the trailing sheet region to be peeled off and for the pad of the turning drum gripper to which the sheet trailing edge is transferred.

In order to implement or realize the here in a forementioned movement sections, which have to be executed within a cylinder rotation angle of about 25°, a dynamically stable guide mechanism is necessary. A precondition therefor is that the mass of the elements of the mechanism be inversely proportional to the size of the movement executed thereby.

Because the sucker carrier sweeps over extreme paths and rotational angles, and is therefore subjected to extreme acceleration, mass and mass moment of inertia have to be kept as low as possible. On the other hand, adequate stiffness of this component is required, in order for it to possess the necessary stability for the sheet transport and to be insensitive or indifferent to accidents (for example, sheets being pulled in and crumpled). The heretofore-known sucker guide mechanism according to German Published, Non-Prosecuted Patent Application DE 198 33 903 A1, corresponding to U.S. Pat. No. 6,401,610, does not optimally meet the aforementioned requirements.

SUMMARY OF THE INVENTION

It is an object of the invention to provide a device for picking up a sheet trailing edge from an upstream cylinder and for transferring the sheet to a gripper system, the device having a low-mass sucker carrier which has, nevertheless, good stiffness characteristics, comparable with those of corresponding steel construction.

With the foregoing and other objects in view, there is provided, in accordance with the invention, a device for picking up a sheet trailing edge from an upstream cylinder and transferring the sheet trailing edge to a gripper system of a downstream drum, as viewed in sheet travel direction. The device comprises a sucker guide mechanism having a movably mounted sucker carrier whereon sucker heads subjectible to an application of vacuum or suction air are disposed. The sucker carrier is constructed as a tubular part having a longitudinal axis and being movable perpendicularly to the longitudinal axis thereof. The tubular part is formed with a vacuum or suction air duct extending in the interior thereof and being formed of carbon fiber-reinforced plastic-material laminate.

In accordance with another feature of the invention, the gripper system is an assembly of turning or reversing grippers.

In accordance with a further feature of the invention, the sucker heads, respectively, are connected mechanically and pneumatically to the tubular sucker carrier via sucker tubes disposed at intervals in a row on the sucker carrier, transversely to the longitudinal axis of the sucker carrier.

In accordance with an added feature of the invention, the sucker tubes are also formed of carbon fiber-reinforced plastic-material laminate.

In accordance with an additional feature of the invention, the pick-up device further comprises a suction air or vacuum connecting piece disposed on the tubular sucker carrier, for supplying suction air or vacuum.

In accordance with yet another feature of the invention, the sucker carrier and sucker tubes are lined on the inside thereof with a foam cambric for reducing suction-air flow cross section.

In accordance with yet a further feature of the invention, the cross-sectional area of the suction-air duct in the tubular sucker carrier is 10% to 30% of the internal cross section prescribed by the carbon fiber-reinforced plastic-material covering.

In accordance with yet an added feature of the invention, the suction-air flow cross section within the sucker tubes, respectively, is 20% to 40% of the sucker tube cross section overall.

In accordance with yet an additional feature of the invention, the foam cambric is formed of a low-mass thermoplastic material.

In accordance with still another feature of the invention, the foam cambric is rigid and is formed of a reactive, closed-cell polyurethane foam.

In accordance with still a further feature of the invention, the low-mass thermoplastic material has a bulk density of about 50 g/dm$^3$.

In accordance with still an added feature of the invention, the rigid foam cambric has an integral structure wherein both in the inner layer thereof adjacent to the suction air duct and in the outer layer thereof adjacent to the carbon fiber material, it has a high density of about 800 g/dm$^3$ and, in the interior lying therebetween, has a lightweight foam structure of about 20 g/dm$^3$.

In accordance with still an additional feature of the invention, the pick-up device further comprises articulated levers engaging with the tubular sucker carrier, the levers and the vacuum or suction-air connecting piece being formed of carbon fiber-reinforced plastic-material laminate.

In accordance with another feature of the invention, the sucker carrier, the sucker tubes, the articulated levers and the suction air or vacuum connecting piece are connected to one another form-lockingly and by locking or joining of material.

In accordance with a further feature of the invention, the articulated levers and the suction air or vacuum connecting piece are also formed of carbon fiber-reinforced plastic-material laminate and a polyurethane core.

In accordance with an added feature of the invention, the carbon fiber-reinforced plastic-material covering of the tubular sucker carrier is formed of a plurality of layers of carbon fiber fabric, which have a given fiber orientation for high flexural and torsional rigidity.

In accordance with an additional feature of the invention, the tubular sucker carrier has a +45°/−45° fiber orientation, with respect to the longitudinal axis thereof, over about 50% of the wall thickness of the carbon fiber structure thereof.

In accordance with yet another feature of the invention, the tubular sucker carrier is provided with a 0° fiber orientation uniformly in the direction of the longitudinal axis thereof over about 50% of the wall thickness of the carbon fiber structure thereof.

In accordance with yet a further feature of the invention, the carbon fiber structure of the sucker tubes has a 0° fiber orientation extending uniformly in the direction of the longitudinal axis of the respective sucker tubes.

In accordance with yet an added feature of the invention, the pick-up device further comprises carbon fiber plastic-material rings formed by circumferential windings disposed at free ends of the sucker tubes, the rings serving for reinforcing the sucker heads and for increasing resistance with respect to a transverse force introduced via the sucker heads.

In accordance with a concomitant feature of the invention, the tubular sucker carrier is constructed as one of binary and tertiary mechanism elements and, accordingly, has a group selected from two and three integrated articulated elements, respectively, of the sucker guide mechanism, a plurality of which is to be disposed over the width of the sucker carrier.

Thus, the sucker carrier according to the invention, including the elements connected mechanically and pneumatically thereto, constitutes a low-mass component nevertheless having a high stiffness. The loading of the elements of the mechanism and the joints of the sucker guide mechanism is thereby reduced considerably, which advantageously leads to a reduction in the deformations caused by inertia. Simultaneously, the inherent or characteristic frequency of the mechanism is increased, as a result of which undesired resonances are displaced to higher drive angular speeds. Both effects increase the operating accuracy of the mechanism and the maximum possible operating rotational speed.

Other features which are considered as characteristic for the invention are set forth in the appended claims.

Although the invention is illustrated and described herein as embodied in a device for picking up a sheet trailing edge from an upstream cylinder and transferring the sheet trailing edge to a gripper system, especially in sheet-fed rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
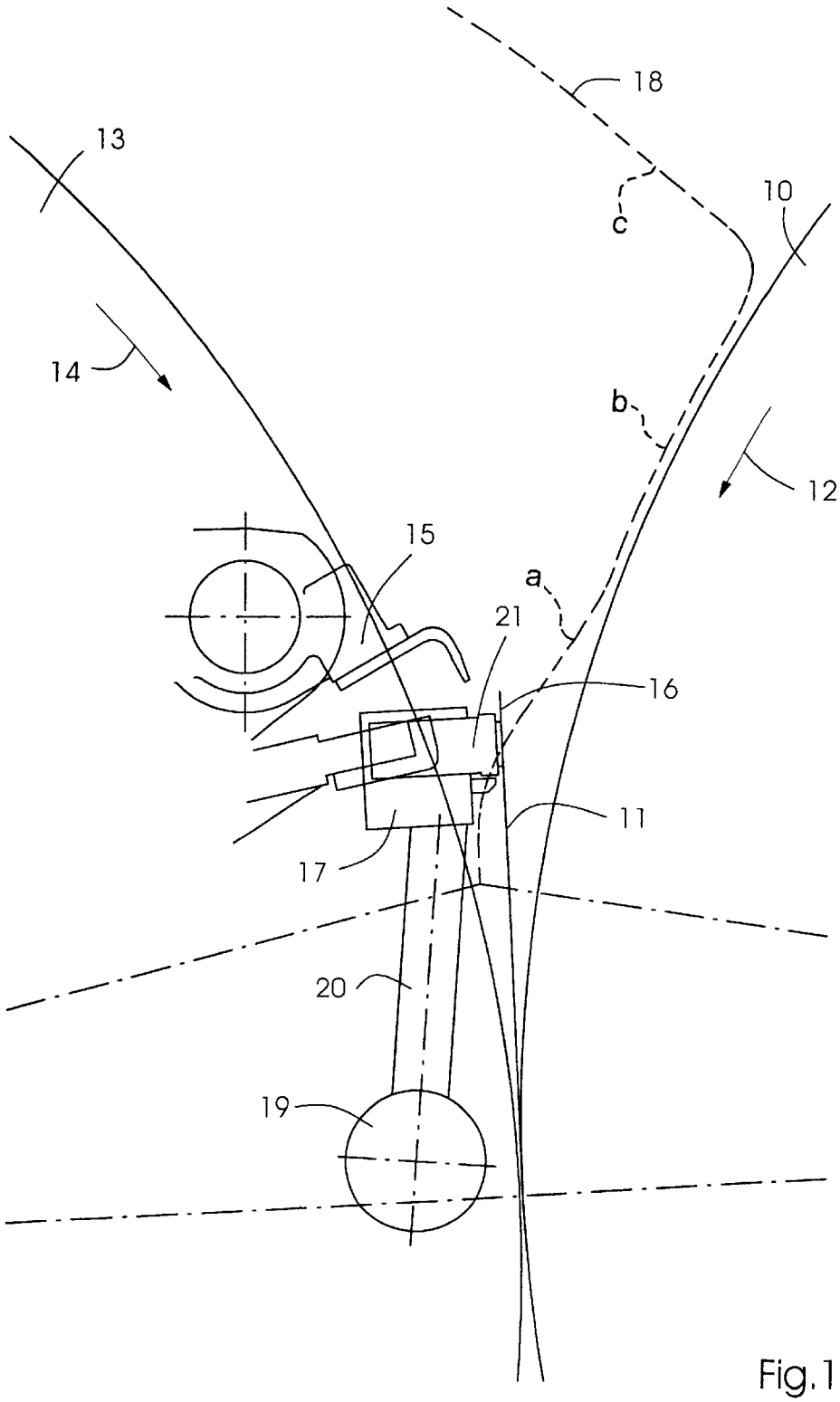
FIG. 1 is a fragmentary diagrammatic and schematic view of a cylinder configuration in a sheet-fed rotary printing press with turning drum grippers and a sucker guide mechanism, shown in part.

Referring now to the drawings and, first, particularly to FIG. 1 thereof, there is shown therein a cylinder 10, for example an impression cylinder transporting a sheet 11. The direction of rotation of the cylinder 10 is represented by an arrow 12. A further cylinder 13 is disposed immediately downstream of the cylinder 10, as viewed in the travel direction of the sheet 11. The cylinder 13 is a reversing or turning drum, which has a direction of rotation represented by an arrow 14. Disposed on the turning drum 13 and revolving therewith is a gripper system-overall identified by reference numeral 15, which is provided for picking up the sheet 11 by the trailing edge 16 thereof and turning or reversing the sheet 11.

In order for the sheet trailing edge 16 and therefore the sheet 11 to be grippable by the gripper system 15, the sheet trailing edge 16 must initially be lifted off the cylinder 10. Serving for this purpose is a sucker, which is overall identified by reference numeral 17, and shown in detail in FIG. 2. The sucker 17 operated by a sucker guide mechanism, shown in part only in the drawing, is likewise disposed on the reversing or turning drum 13 so as to revolve therewith. Through the intermediary of the sucker guide mechanism, the sucker 17 and the sucker heads thereof (note FIG. 2) are moved along a curved path represented by a broken line 18 in FIG. 1, which contains three sections necessitated by the process: a suction section a, a peeling section b and a transfer section c. In all three sections, care must additionally be taken to ensure specific positional angles of the suction faces relative to the cylinder 10, to the trailing sheet region 16 to be peeled off and to the pad of the turning drum gripper 15, to which the sheet trailing edge 16 is transferred.

Figure 2:
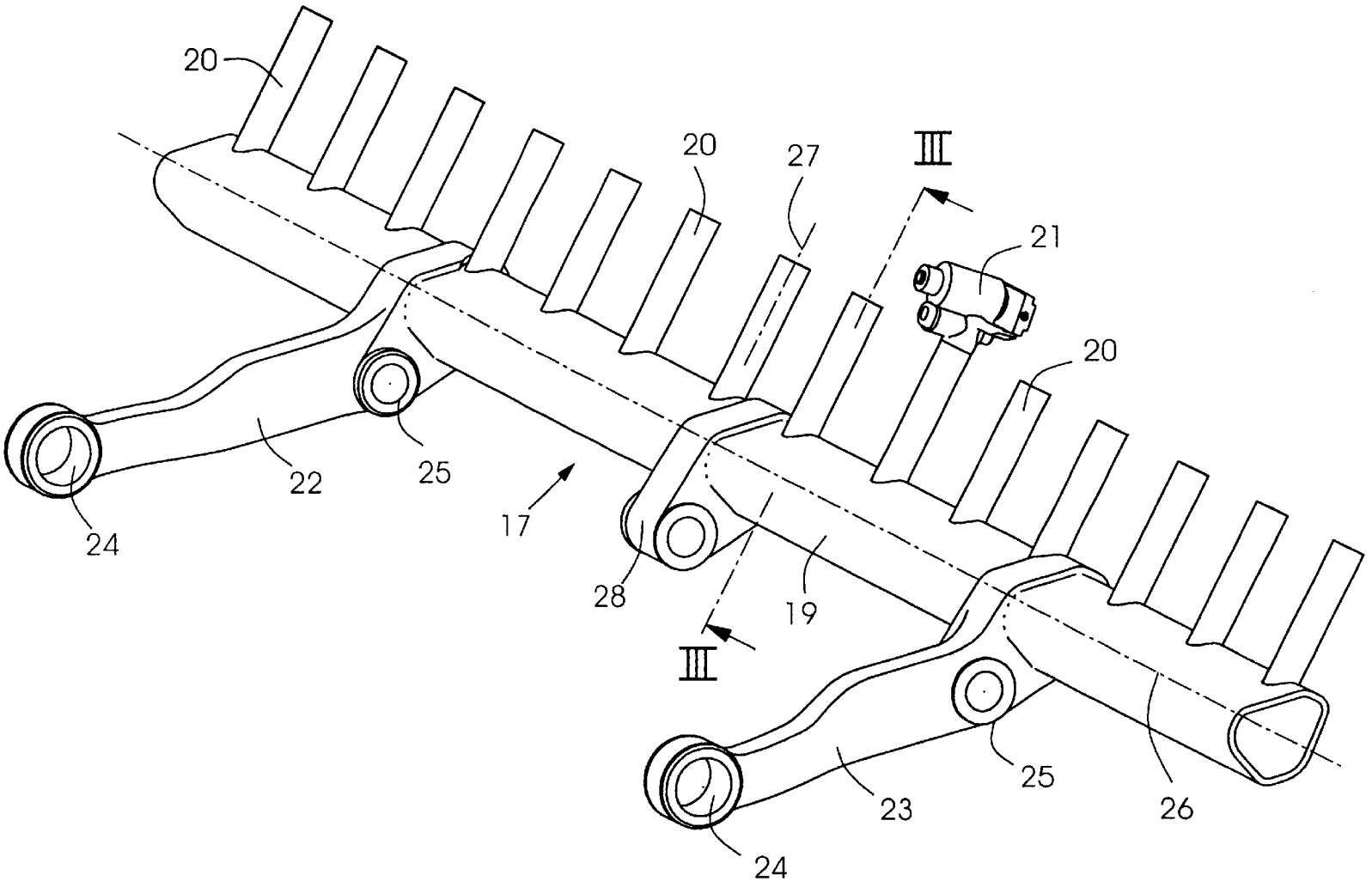
FIG. 2 is a fragmentary perspective view of FIG. 1, showing the sucker guide mechanism in greater detail.
Figure 3:
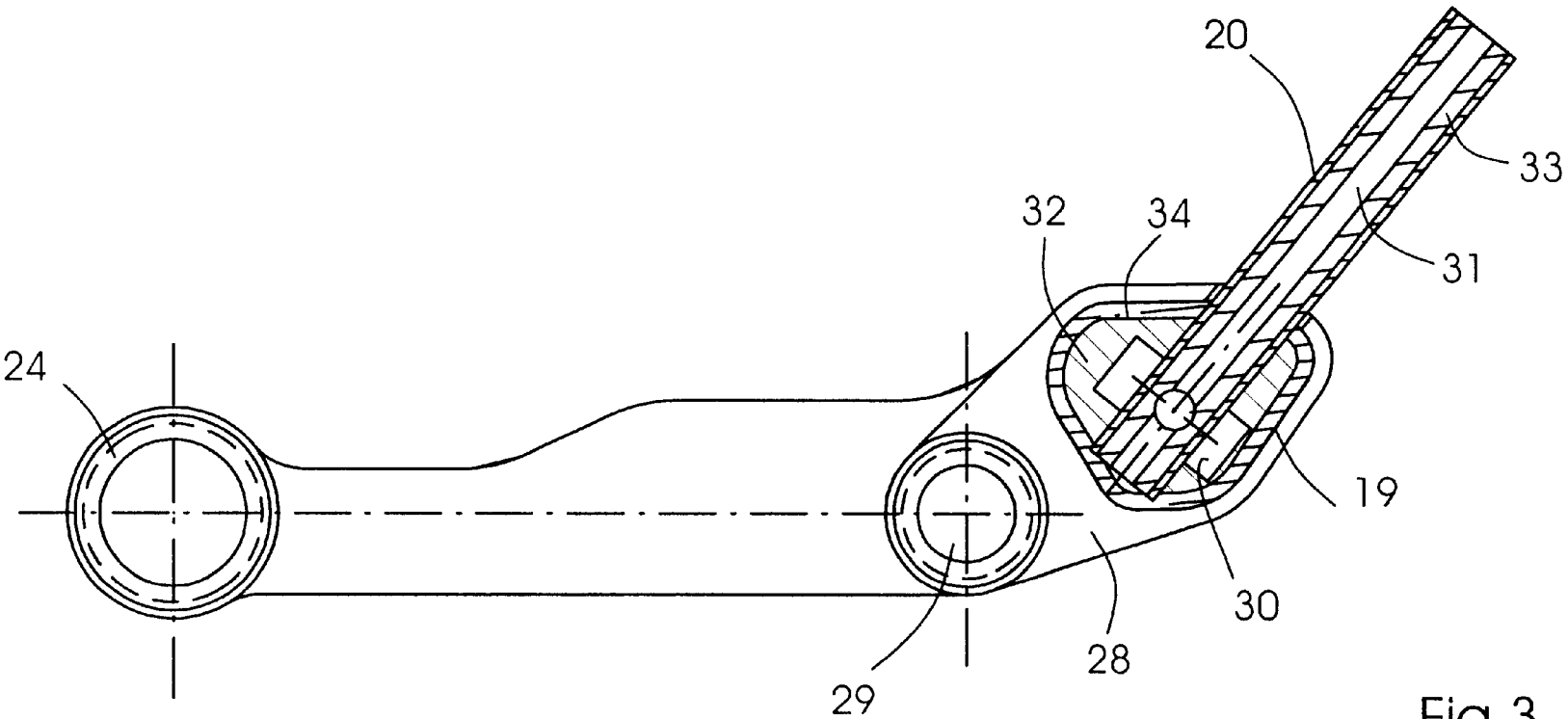
FIG. 3 is a fragmentary enlarged cross-sectional view of FIG. 2 taken along the line III-III in the direction of the arrows.

As is apparent in particular from FIG. 2 (but note also FIG. 3), the sucker 17 has a tubular sucker carrier 19 of polygonal or circular cross section, into which sucker tubes 20 are inserted. Fixed to the free ends of the sucker tubes 20 are sucker heads 21, only one of which is shown in FIG. 2. In addition, articulated levers 22 and 23 are undetachably form-lockingly and force-lockingly connected to the tubular sucker carrier 19, two metal bushings 24 and 25, respectively, being laminated as articulated elements in the articulated levers 22 and 23. In this regard, it is noted that a form-locking connection is one which connects two elements together due to the shape of the elements themselves, as opposed to a force-locking connection, which locks the elements together by force external to the elements. The articulated levers 22 and 23, together with the articulated elements 24 and 25, form kinematically necessary constituent parts of the sucker mechanism. In this regard, the metal bushings 24 and 25 can serve as holders for non-illustrated rolling bearings and articulating or hinge pins, respectively, or have a direct rotational connection to the articulated elements of adjacent elements of the sucker guide mechanism. In order to improve form-lockingly the seat of the metal bushings 24 and 25 in the articulated levers 22 and 23, respectively, the surrounding inner covering or casing surface of the respective articulated lever 22 and 23, respectively, can be structured, for example, knurled.

The tubular sucker carrier 19 contains a plurality of layers of carbon-fiber fabric, which have a specific fiber orientation for high flexural and torsional rigidity. For this purpose, preferably in the outer region of the tubular sucker carrier 19, a +45°/−45° fiber orientation with respect to the longitudinal axis 26 is realized or implemented to a thickness of about 50% of the overall wall thickness of the carbon fiber structure in order to absorb the torsional loading. In the inner region of the carbon fiber structure, a 0° fiber orientation is provided uniformly in the direction of the longitudinal axis 26 in order to achieve a high flexural rigidity.

The sucker tubes 20 have a specifically uniformly directed 0° fiber orientation along the respective longitudinal axis 27 thereof in order to achieve a high flexural rigidity. At the free ends of the sucker tubes 20, in order to reinforce the sucker heads 21 and to increase resistance with respect to the transverse force introduced via the sucker heads 21, non-illustrated rings of carbon fiber plastic material produced by circumferential windings are disposed.

The articulated levers 22 and 23 are fabricated from an individual roving (individual fibers) and fabric. The roving in the articulated levers 22 and 23 is processed in accordance with a specific laying configuration, in order to guarantee an optimum fiber course suitable for the loading.

The articulated levers 22 and 23 are adhesively-bonded form lockingly and by a locking or joining of material to the tubular sucker carrier. In a similar manner, a vacuum or suction-air connecting-piece 28 is adhesively bonded to the tubular sucker carrier 19 and, together with the tubular sucker carrier 19 and the sucker tubes 20, serves for supplying the sucker heads 21 with cycled suction air or vacuum.

When the sheet trailing edge 16 is gripped by suction (FIG. 1), the suction air flow initially causes the sheet 11 to spring dynamically onto the sucker heads 21. After the sheet 11 has been placed on the sucker heads 21, the latter are sealed off by the sheet 11. In the pneumatically connected suction ducts 29, 30 and 31 in FIG. 3 belonging to the vacuum or suction-air connecting piece 28, the sucker carrier 19 and the sucker tubes 20, the vacuum increases to a maximum static value, by which the sheet 11 is held.

A further special feature is that, in order to minimize the volume to be evacuated and to accelerate the time-critical build-up of the vacuum, the cross-sectional dimensions of the suction ducts 30 and 31 are reduced to the necessary flow cross section which is required to cause the trailing edge to spring off. For this purpose, as is revealed in FIG. 3, the tubular sucker carrier 19 and the sucker tubes 20 are lined with a low-mass thermoplastic foam inlet 32 and 33, respectively. This is formed of a reactive, closed-cell polyurethane foam, preferably with a bulk density of about 50 g/dm$^3$. As a result of specific temperature management, the rigid foam inlet has an integral structure which is distinguished by a dense marginal layer of the regions facing the vacuum and the carbon fibers, respectively, with a density of about 800 g/dm$^3$, and a lightweight foam structure in the interior of the inlet, with a density of about 20 g/dm$^3$.

While the cross section 31 through which the air flows in the sucker tubes 20 is about 20% to 40% of the sucker tube outer diameter, the vacuum duct 30 in the tubular sucker carrier 19 has a cross-sectional area of 10% to 30% of the cross-sectional area which is covered by the inner carbon fiber, plastic-material covering surface 34.

The here in a foredescribed construction of a low-mass sucker carrier 19, including the articulated levers 22 and 23, the vacuum or suction air connecting piece 28 and the sucker tubes 20, with an adequate component stiffness, reduces the loading on the elements of the mechanism and the articulations of the sucker guide mechanism, which leads to a reduction in the deformations caused by inertia. Simultaneously, the inherent or characteristic frequency of the mechanism is increased, as a result of which, undesired resonances are displaced to higher drive angular speeds. Both effects increase the operating accuracy of the sucker guide mechanism and the maximum possible operating rotational speed.

We claim:

1. A device for picking up a sheet trailing edge from an upstream cylinder and transferring the sheet trailing edge to a gripper system of a downstream drum, in sheet travel direction, the device comprising a sucker guide mechanism having a movably mounted sucker carrier and sucker heads disposed on said sucker carrier for being subjected to an application of vacuum or suction air, said sucker carrier being a tubular part having a longitudinal axis and being movable perpendicularly to said longitudinal axis, said tubular part having an interior and a vacuum or suction air duct extending in said interior and said tubular part formed of carbon fiber-reinforced plastic-material laminate.

2. The pick-up device according to claim 1, wherein the gripper system is an assembly of turning or reversing grippers.

3. The pick-up device according to claim 1, which further comprises sucker tubes disposed at intervals in a row on said sucker carrier, transversely to said longitudinal axis of said sucker carrier, said sucker heads being respectively connected mechanically and pneumatically to said tubular sucker carrier via said sucker tubes.

4. The pick-up device according to claim 1, wherein said sucker tubes are also formed of carbon fiber-reinforced plastic-material laminate.

5. The pick-up device according to claim 4, wherein said sucker tubes have an overall cross section and a suction-air flow cross section within said sucker tubes respectively being 20% to 40% of said overall sucker tube cross section.

6. The pick-up device according to claim 4, wherein said sucker tubes have a carbon fiber structure with a 0° fiber orientation extending uniformly in the direction of the longitudinal axis of said respective sucker tubes.

7. The pick-up device according to claim 4, wherein said sucker tubes have free ends, and carbon fiber plastic-material rings formed by circumferential windings are disposed at free ends of said sucker tubes, said rings reinforcing said sucker heads and increasing resistance with respect to a transverse force introduced via said sucker heads.

8. The pick-up device according to claim 1, further comprising a suction air or vacuum connecting piece disposed on said tubular sucker carrier, for supplying suction air or vacuum.

9. The pick-up device according to claim 8, further comprising a vacuum or suction-air connecting piece connected to said tubular sucker carrier, and articulated levers engaging with said tubular sucker carrier, said levers and said vacuum or suction-air connecting piece being formed of carbon fiber-reinforced plastic-material laminate.

10. The pick-up device according to claim wherein said articulated levers and said suction air or vacuum connecting piece are also formed of carbon fiber-reinforced plastic-material laminate and a polyurethane core.

11. The pick-up device according to claim 9, wherein said sucker carrier, said sucker tubes, said articulated levers and said suction air or vacuum connecting piece are connected to one another form-lockingly and by locking or joining of material.

12. The pick-up device according to claim 1, wherein said sucker carrier and sucker tubes have an inside surface lined with a foam cambric for reducing suction-air flow cross section.

13. The pick-up device according to claim 12, which further comprises a carbon fiber-reinforced plastic-material covering for said suction-air duct in said tubular sucker carrier, said carbon fiber-reinforced plastic-material covering prescribing an internal cross section, and said suction-air duct having a cross-sectional area being 10% to 30% of said internal cross section prescribed by said carbon fiber-reinforced plastic-material covering.

14. The pick-up device according to claim 12, wherein said foam cambric is formed of a low-mass thermoplastic material.

15. The pick-up device according to claim 14, wherein said low-mass thermoplastic material has a bulk density of about 50 g/dm$^3$.

16. The pick-up device according to claim 14, wherein said foam cambric is rigid and is formed of a reactive, closed-cell polyurethane foam.

17. The pick-up device according to claim 16, wherein said rigid foam cambric has an integral structure with an inner layer thereof adjacent said suction air duct and an outer layer thereof adjacent said carbon fiber material both having a high density of about 800 g/dm$^3$, and an interior lying therebetween having a lightweight foam structure of about 20 g/dm$^3$.

18. The pick-up device according to claim 1, wherein said carbon fiber-reinforced plastic-material laminate covering said tubular sucker carrier is formed of a plurality of layers of carbon fiber fabric, having a given fiber orientation for high flexural and torsional rigidity.

19. The pick-up device according to claim 18, wherein said tubular sucker carrier has a carbon fiber structure with a given wall thickness and a +45°/−45° fiber orientation, with respect to the longitudinal axis thereof, over about 50% of said given wall thickness.

20. The pick-up device according to claim 18, wherein said tubular sucker carrier has a carbon fiber structure with a given wall thickness and a 0° fiber orientation uniformly in the direction of the longitudinal axis thereof over about 50% of said given wall thickness.

21. The pick-up device according to claim 1, wherein said tubular sucker carrier has a width and is a binary mechanism element having two integrated articulated elements of said sucker guide mechanism, and a plurality of said integrated articulated elements are to be disposed over the width of said sucker carrier.

22. The pick-up device according to claim 1, wherein said tubular sucker carrier has a width and is a tertiary mechanism element having three integrated articulated elements of said sucker guide mechanism, and a plurality of said integrated articulated elements are to be disposed over the width of said sucker carrier.

* * * * *